US009141033B2

(12) United States Patent
Itabashi et al.

(10) Patent No.: US 9,141,033 B2
(45) Date of Patent: Sep. 22, 2015

(54) CARTRIDGE

(71) Applicants: Nao Itabashi, Nagoya (JP); Ryuya Yamazaki, Nagoya (JP)

(72) Inventors: Nao Itabashi, Nagoya (JP); Ryuya Yamazaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1 day.

(21) Appl. No.: 13/848,758

(22) Filed: Mar. 22, 2013

(65) Prior Publication Data

US 2013/0287436 A1 Oct. 31, 2013

(30) Foreign Application Priority Data

Apr. 27, 2012 (JP) ..... 2012-103670

(51) Int. Cl.
*G03G 15/04* (2006.01)
*G03G 15/08* (2006.01)

(52) U.S. Cl.
CPC ..... *G03G 15/0896* (2013.01); *G03G 15/0812* (2013.01)

(58) Field of Classification Search
USPC ..... 399/119, 284
See application file for complete search history.

(56) References Cited

U.S. PATENT DOCUMENTS

| | | | | |
|---|---|---|---|---|
| 8,170,442 | B2 | 5/2012 | Sato et al. | |
| 2009/0180816 | A1 | 7/2009 | Sato et al. | |
| 2012/0051800 | A1 * | 3/2012 | Yamazaki et al. | 399/284 |

FOREIGN PATENT DOCUMENTS

| | | | |
|---|---|---|---|
| JP | 07-333982 | A | 12/1995 |
| JP | 2009-168993 | A | 7/2009 |

* cited by examiner

*Primary Examiner* — Erika J Villaluna
(74) *Attorney, Agent, or Firm* — Banner & Witcoff, Ltd.

(57) ABSTRACT

A cartridge includes: a housing that has a first wall part and a second wall part arranged at an interval from the first wall part and is configured to accommodate developer; a developer carrier that is rotatably supported to the housing and carries the developer; a layer thickness regulation member that is supported to the housing so that it is arranged at an opposite side to the second wall part with respect to the first wall part and that is configured to regulate a layer thickness of the developer carried on a surface of the developer carrier, and a covering member that is arranged at an opposite side to the second wall part with respect to the layer thickness regulation member and covers the layer thickness regulation member, wherein the covering member has a grip to grip the housing.

7 Claims, 10 Drawing Sheets

CARTRIDGE

CROSS-REFERENCE TO RELATED APPLICATION

This application claims priority from Japanese Patent Application No. 2012-103670 filed on Apr. 27, 2012, the entire subject matter of which is incorporated herein by reference.

TECHNICAL FIELD

This disclosure relates to a cartridge that is to be mounted to an image forming apparatus of an electrophotographic type.

BACKGROUND

In the background of this disclosure, there is a developing cartridge that is detachably mounted to an image forming apparatus, and the developing cartridge has a developing frame accommodating toner therein, a developing roller carrying the toner thereon and a blade assembly regulating a layer thickness of the toner carried on the developing roller.

In the above developing cartridge, the developing frame has a lower frame that rotatably supports the developing roller and an upper frame that is welded to the lower frame. The developing frame is formed with an opening set by a front end portion of the upper frame and both sidewalls and a bottom wall of the lower frame. The developing roller is arranged to face the opening.

The blade assembly is fixed to an upper side of the upper frame so that a contact part thereof contacting the developing roller is arranged between the opening and the developing roller.

SUMMARY

In the above-described cartridge, a reinforcement part of the blade assembly fixed to the upper frame is exposed. Therefore, when the cartridge is small, a finger contacts the reinforcement member at the time that a user grips and handles the cartridge with one hand. Accordingly, excessive load is also applied to the developing roller contacting the blade assembly, so that the developing roller may be damaged.

Also, when a tip part of the reinforcement member has a sharp-pointed shape, the handling property is deteriorated because it is necessary to grip only the upper and lower frames so that the tip part is not contacted.

Accordingly, this disclosure provides at least a cartridge that is possible to smoothly handle with protecting a layer thickness regulation member and also a developer carrier contacting the layer thickness regulation member.

In view of the above, a cartridge of this disclosure comprises: a housing that has a first wall part and a second wall part arranged at an interval from the first wall part and is configured to accommodate developer; a developer carrier that is rotatably supported to the housing and carries the developer; a layer thickness regulation member that is supported to the housing so that it is arranged at an opposite side to the second wall part with respect to the first wall part and that is configured to regulate a layer thickness of the developer carried on a surface of the developer carrier, and a covering member that is arranged at an opposite side to the second wall part with respect to the layer thickness regulation member and covers the layer thickness regulation member, wherein the covering member has a grip to grip the housing.

The cartridge of this disclosure is capable of protecting the layer thickness regulation member and also the developer carrier contacting the layer thickness regulation member, and it is to be smoothly handled.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

1. Overall Configuration of Printer

Figure 1:
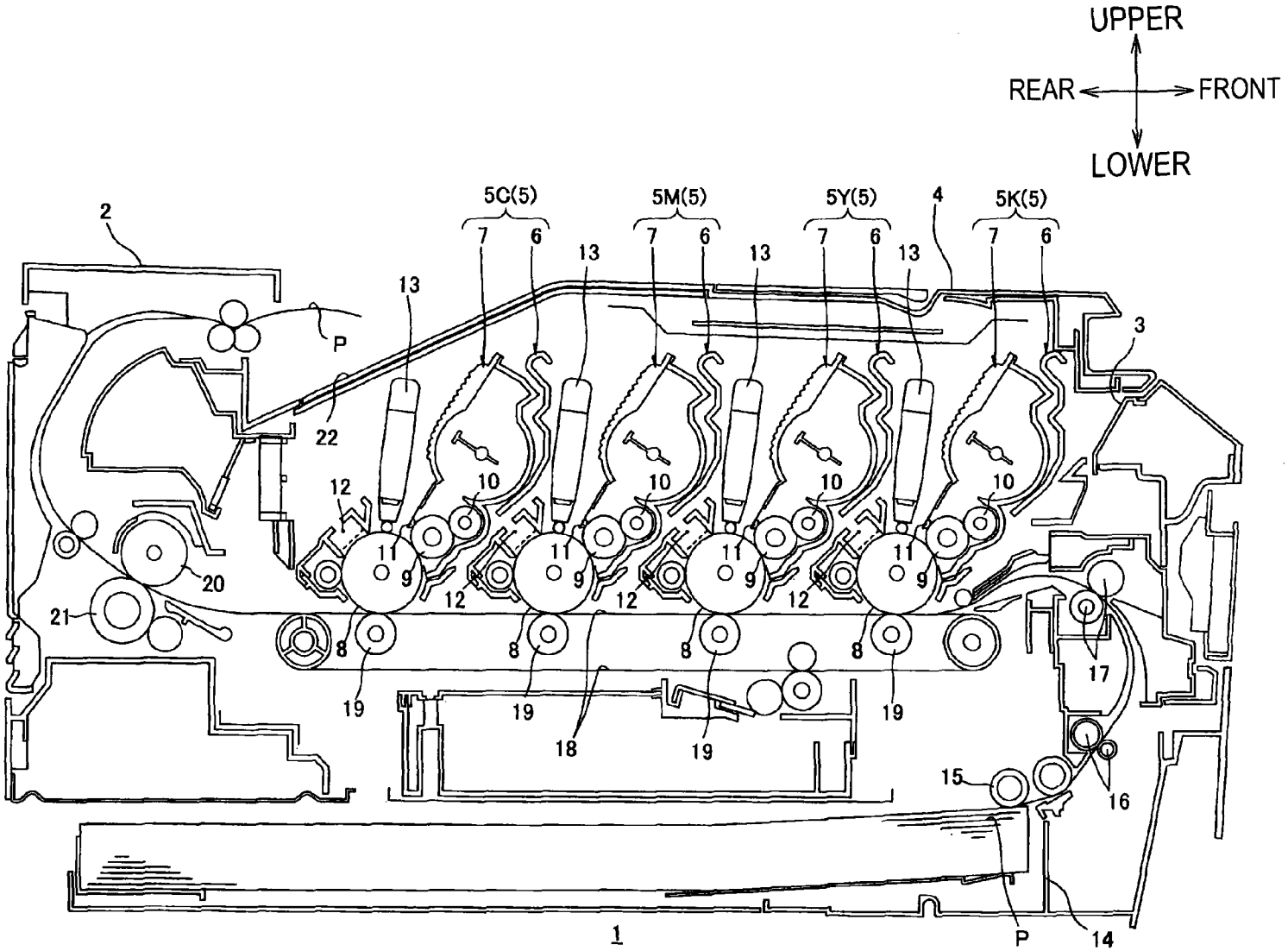
FIG. 1 is a sectional view illustrating a printer to which a developing cartridge according to a first illustrative embodiment of the developing cartridge of this disclosure is to be mounted.

As shown in FIG. 1, a printer 1 is a direct tandem-type color printer of a horizontal arrangement type.

In the below descriptions, the directions are described on the basis of a state where the printer 1 is horizontally put. That is, a right side of FIG. 1 is referred to as a front side and a left side of FIG. 1 is referred to as a rear side. Also, the left and the right sides of the printer 1 are described on the basis of a state where the printer 1 is seen from the front side. That is, the front side of FIG. 1 is the left side and the back side of FIG. 1 is the right side.

The printer 1 has a body casing 2 having a substantial box shape. An upper end portion of the body casing 2 is provided with a top cover 4 for opening and closing a body opening 3 so that it can be rotated about a rear end portion thereof serving as a support point. The printer 1 has a plurality (four) of process cartridges 5 in correspondence to a plurality (four) of colors (black, yellow, magenta and cyan).

The process cartridges 5 are detachably mounted in the body casing 2 and are arranged in parallel at an interval in the front-rear direction.

Also, each of the process cartridges 5 has a drum cartridge 6 and a developing cartridge 7 that is an example of the cartridge to be detachably mounted to the drum cartridge 6.

The drum cartridge 6 has a photosensitive drum 8.

The developing cartridge 7 has a developing roller 9 that is an example of the developer carrier.

The developing roller 9 extends in the left-right direction (rotary shaft direction), is provided to a rear end portion of the developing cartridge 7 so that it is exposed from the rear and is contacted to the photosensitive drum 8 from the front-upper side of the photosensitive drum.

Also, the developing cartridge 7 has a supply roller 10 that supplies toner to the developing roller 9 and a layer thickness regulation blade 11 that is an example of the layer thickness regulation member regulating a thickness of the toner supplied to the developing roller 9. The toner is an example of the developer, and it is accommodated in an upper side of the supply roller and the layer thickness regulation blade.

The toner in the developing cartridge 7 is positively friction-charged between the supply roller 10 and the developing roller 9 and then is carried on a surface of the developing roller 9 as a thin layer having a predetermined thickness with a layer thickness thereof being regulated by the layer thickness regulation blade 11.

In the meantime, a surface of the photosensitive drum 8 is uniformly charged by a scorotron-type charger 12, which is arranged to face the photosensitive drum 8 at the rear-upper side of the photosensitive drum, and then it is exposed based on predetermined image data by an LED unit 13 that is arranged to face the photosensitive drum 8 from the upper side of the photosensitive drum. Thereby, an electrostatic latent image based on the image data is formed. The toner carried on the developing roller 9 is supplied to the electrostatic latent image on the surface of the photosensitive drum 8, so that a toner image is carried on the surface of the photosensitive drum 8.

A sheet P is accommodated in a sheet feeding tray 14 that is provided at a bottom part of the body casing 2, and is conveyed to U-turn toward the rear-upper side by a pick-up roller 15, feeder rollers 16 and a pair of register rollers 17, so that it is fed one by one between the photosensitive drums 8 and a conveyance belt 18 at predetermined timing. Then, the sheet is conveyed from the front toward the rear between the photosensitive drums 8 and transfer rollers 19 by the conveyance belt 18. At this time, toner images of all colors are sequentially transferred onto the sheet P, so that a color image is formed.

Then, the sheet P is heated and pressurized when passing between a heating roller 20 and a pressing roller 21. At this time, the color image is heat-fixed on the sheet P.

After that, the sheet P is conveyed to U-turn toward the front-upper side and is then discharged onto a sheet discharge tray 22 that is provided to the top cover 4.

2. Developing Cartridge

(1) Developing Frame

Figure 2:
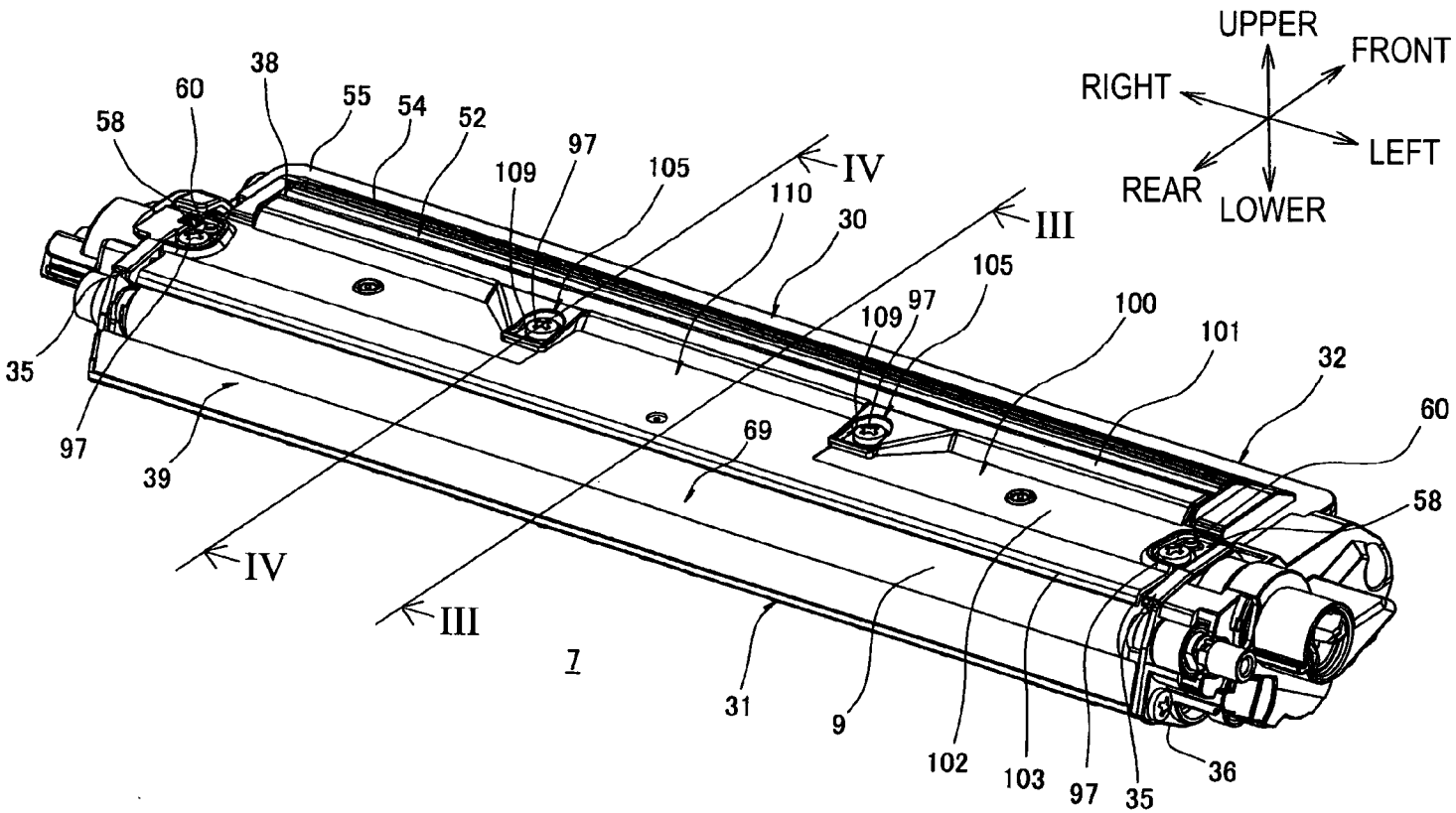
FIG. 2 is a perspective view of the developing cartridge shown in FIG. 1, as viewed from the left-upper side.
Figure 3:
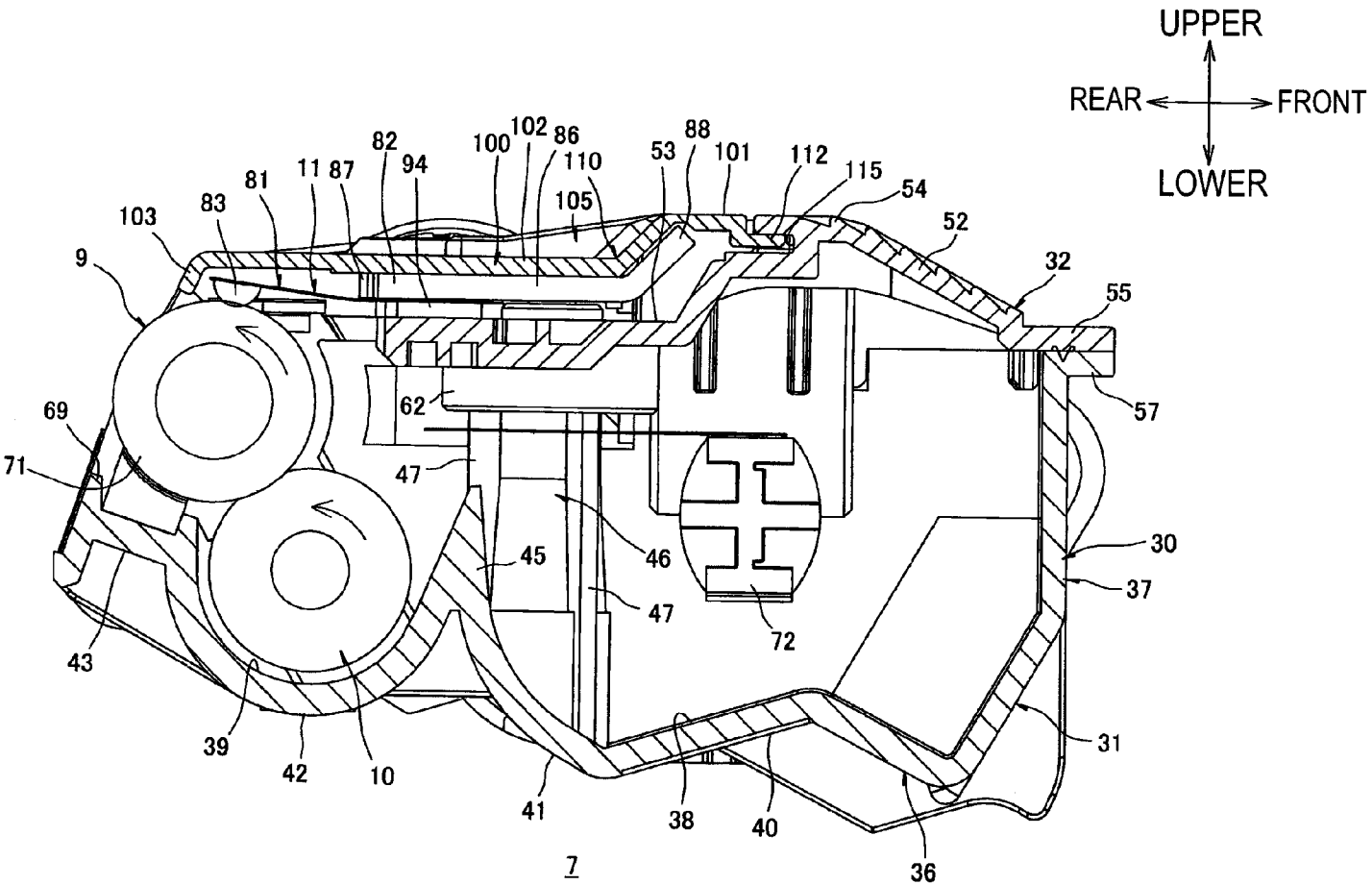
FIG. 3 is a sectional view taken along a line III-III of the developing cartridge shown in FIG. 2.

As shown in FIGS. 2 and 3, the developing cartridge 7 has a developing frame 30 that is an example of the housing.

The developing frame 30 has a substantially box shape extending in the left-right direction and includes a lower frame 31 and an upper frame 32 that is an example of the first wall part.

(1-1) Lower Frame

Figure 5:
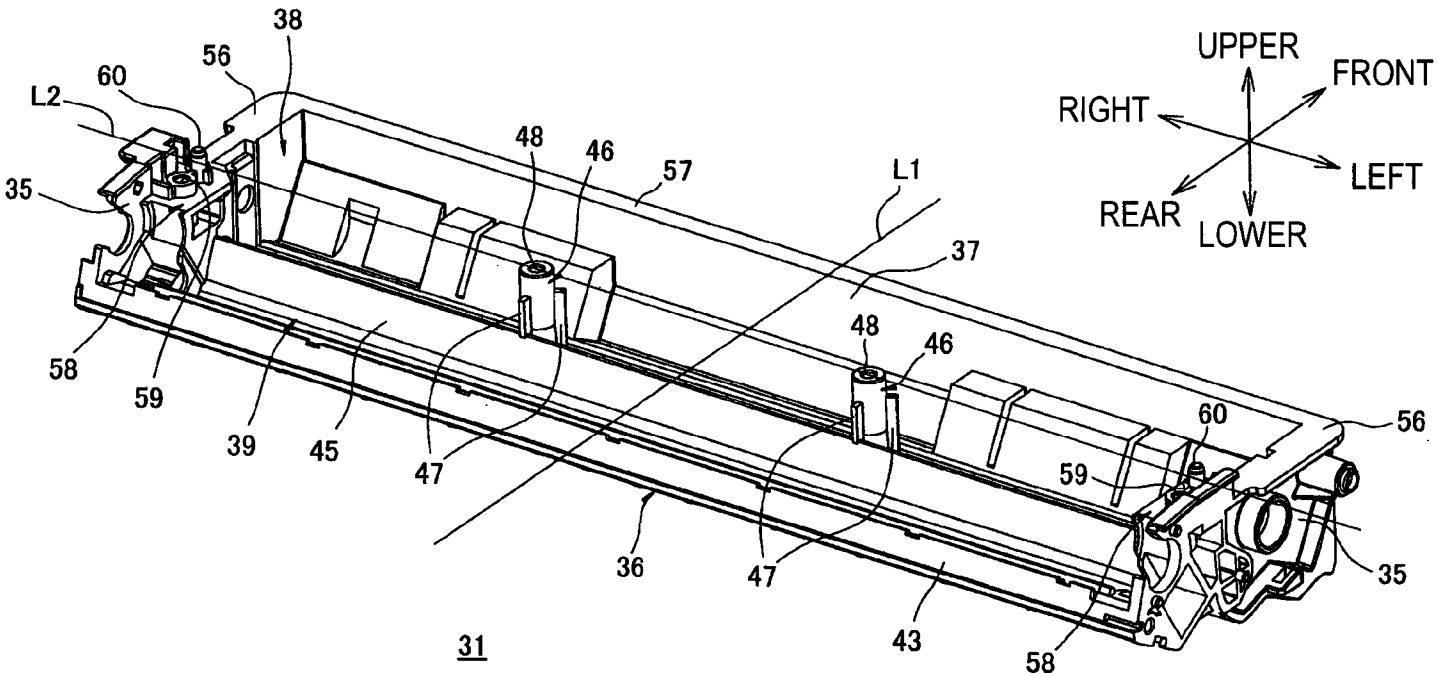
FIG. 5 is a perspective view of a lower frame shown in FIG. 2, as viewed from the left-upper side.

As shown in FIGS. 3 and 5, the lower frame 31 has a substantially rectangular frame shape having opened upper and rear sides, as viewed from a plan view, and integrally has a pair of sidewalls 35 that is arranged to face each other at an interval in the left-right direction, a front wall 37 that connects front end portions of both sidewalls 35 and a bottom wall 36 that is an example of the second wall part connecting lower end portions of both sidewalls 35 and the front wall 37.

Each of the pair of sidewalls 35 has a substantially flat plate shape extending in the front-rear direction and is formed with a first abutted part 56 and a first fixing part 58 at an upper end portion thereof.

The first abutted part 56 has a substantially flat plate shape that extends outwards in the left-right direction continuously from an upper end of a front part of the sidewall 35.

The first fixing part 58 has a substantially flat plate shape that extends inwards in the left-right direction continuously from an upper end of a rear part of the sidewall 35. The first fixing part 58 is formed with a first screw hole 59 and a positioning protrusion 60.

The first screw hole 59 is formed to penetrate in the upper-lower direction at a central part of the first fixing part 58.

The positioning protrusion 60 is provided at a front side from the first screw hole 59 and has a substantially cylindrical shape that protrudes upwards from the first fixing part 58. A tip of the positioning protrusion 60 is convex upwards and has a substantially arc-shaped section.

The front wall 37 has a substantially flat plate shape extending in the upper-lower direction. Specifically, a lower part of the front wall is inclined upward as proceeding forward, and an upper part thereof extends upwards continuously from an upper end portion of the lower part.

Also, an upper end portion of the front wall 37 is formed with a second abutted part 57.

The second abutted part 57 has a substantially flat plate shape that extends forwards continuously from an upper end of the front wall 37.

The bottom wall 36 has a bent wall 40 and a curved wall 41 at a front part thereof and an arc-shaped wall 42 and a lip part 43 at a rear part thereof. The bottom wall 36 is configured by the bent wall 40, the curved wall 41, the arc-shaped wall 42 and the lip part 43, which are continuously formed in corresponding order from the front side.

The bent wall 40 has a flat plate shape that extends rearwards continuously from a lower end portion of the front wall 37. Specifically, the bent wall 40 is inclined upward as proceeding rearward, and then it is bent and is then s inclined downwards as proceeding rearwards.

The curved wall 41 has a substantial arc shape that extends rearwards continuously from a rear end portion of the bent wall 40 with following a rotating trajectory of an agitator 72 (which will be described later).

The arc-shaped wall 42 has a substantial arc shape that extends rearwards continuously from a rear end portion of the curved wall 41 with following a rotating trajectory of the supply roller 10.

The lip part 43 has a substantially T-shaped section that protrudes rearwards continuously from a rear end portion of the arc-shaped wall 42. A lower sponge 71 having a substantially rectangular section is attached on an upper surface of the lip part 43.

Also, the bottom wall 36 is formed with a partition wall 45 at a central part in the front-rear direction.

The partition wall 45 extends upwards continuously from the rear end portion of the curved wall 41 and a front end portion of the arc-shaped wall 42. An upper end edge of the partition wall 45 is substantially flush with an upper end edge of the supply roller 10. The partition wall 45 is arranged to face a lower surface of a rear-side upper wall 53 (which will be described later) of the upper frame 32 at an interval in the upper-lower direction.

Figure 4:
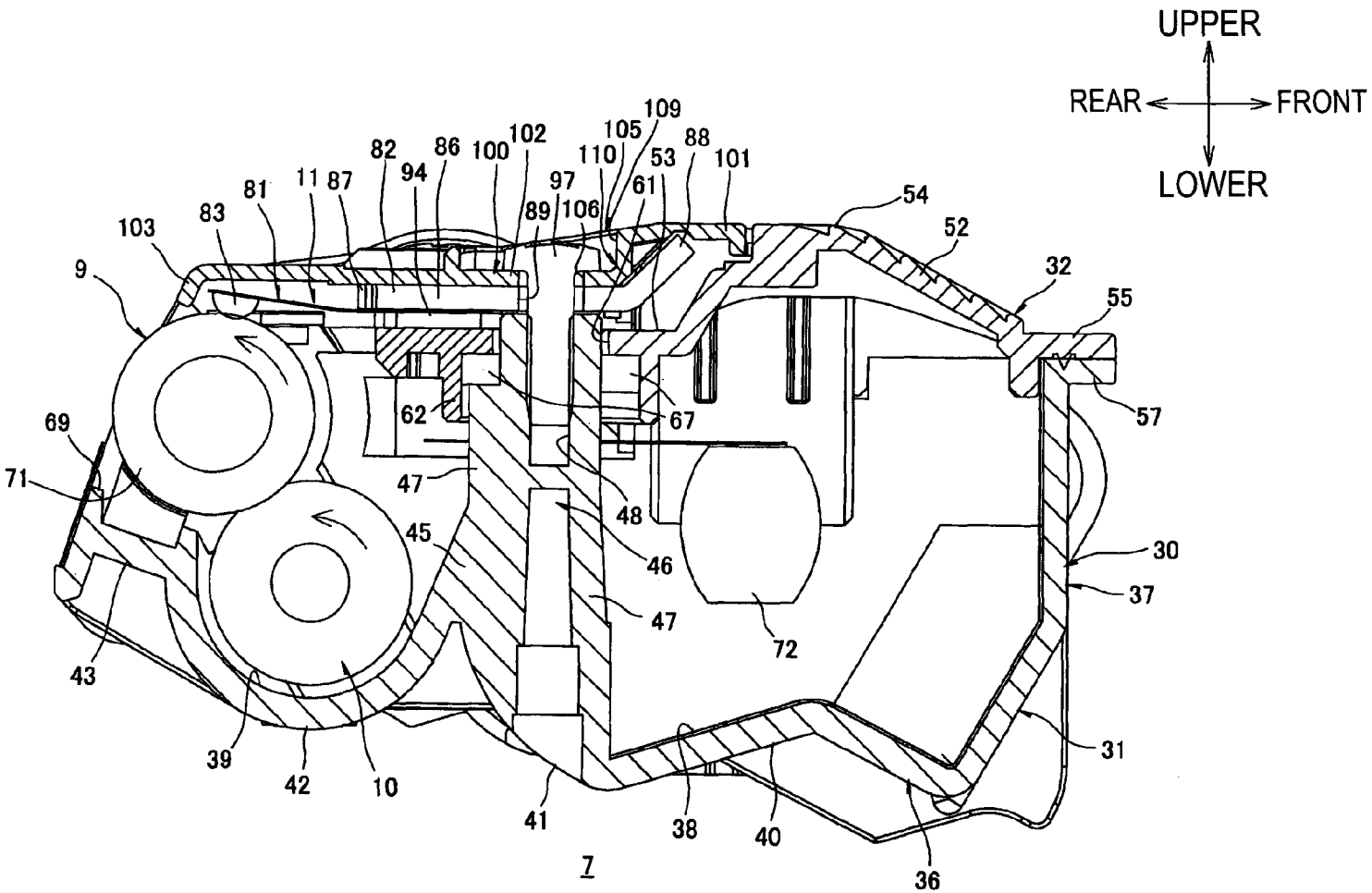
FIG. 4 is a sectional view taken along a line IV-IV of the developing cartridge shown in FIG. 2.

Also, as shown in FIGS. 4 and 5, the bottom wall 36 is formed with a plurality of (two) second fixing parts 46 that are an example of a fixing part so that they are adjacent to a front side of the partition wall 45.

The second fixing parts 46 are arranged in parallel at an interval so that they equidistantly divide the interval between both sidewalls 35 at a central part of the lower frame 31 in the left-right direction. Specifically, the second fixing parts 46 are arranged line-symmetrically with respect to a line L1, which passes through the center of the lower frame 31 in the left-right direction, at an interval in the left-right direction, which is larger than a length of a grip 110 (which will be described later) in the left-right direction.

Also, all the second fixing parts 46 and all the positioning protrusions 60 are arranged on the same line L2 along the left-right direction.

The second fixing part 46 has a substantially cylindrical shape and is formed to stand upwards from the rear end portion of the curved wall 41.

An upper end edge of the second fixing part 46 is higher than an upper end edge of the partition wall 45 and is substantially flush with an upper end edge of the part of the first fixing part 58 at which the first screw hole 59 is formed.

The second fixing part 46 is formed with a second screw hole 48. The second screw hole 48 is formed by punching downwards an upper surface of the second fixing part 46 and has a substantially circular shape, as viewed from a plan view.

Also, the second fixing part 46 has a plurality (three) of projections 47 on an outer peripheral surface thereof.

The projection 47 has a substantially flat plate shape that protrudes diametrically outwards from the outer peripheral surface of the second fixing part 46 and extends in the upper-lower direction. The projection 47 is formed partway from a base end portion (lower end portion) of the second fixing part 46 in the upper-lower direction and an upper end surface thereof faces a lower surface of the rear-side upper wall 53 (which will be described later).

Also, the projections 47 are formed at an equal interval of about 120 degrees in the circumferential direction on the outer peripheral surface of the second fixing part 46.

(1-2) Upper Frame

Figure 6:
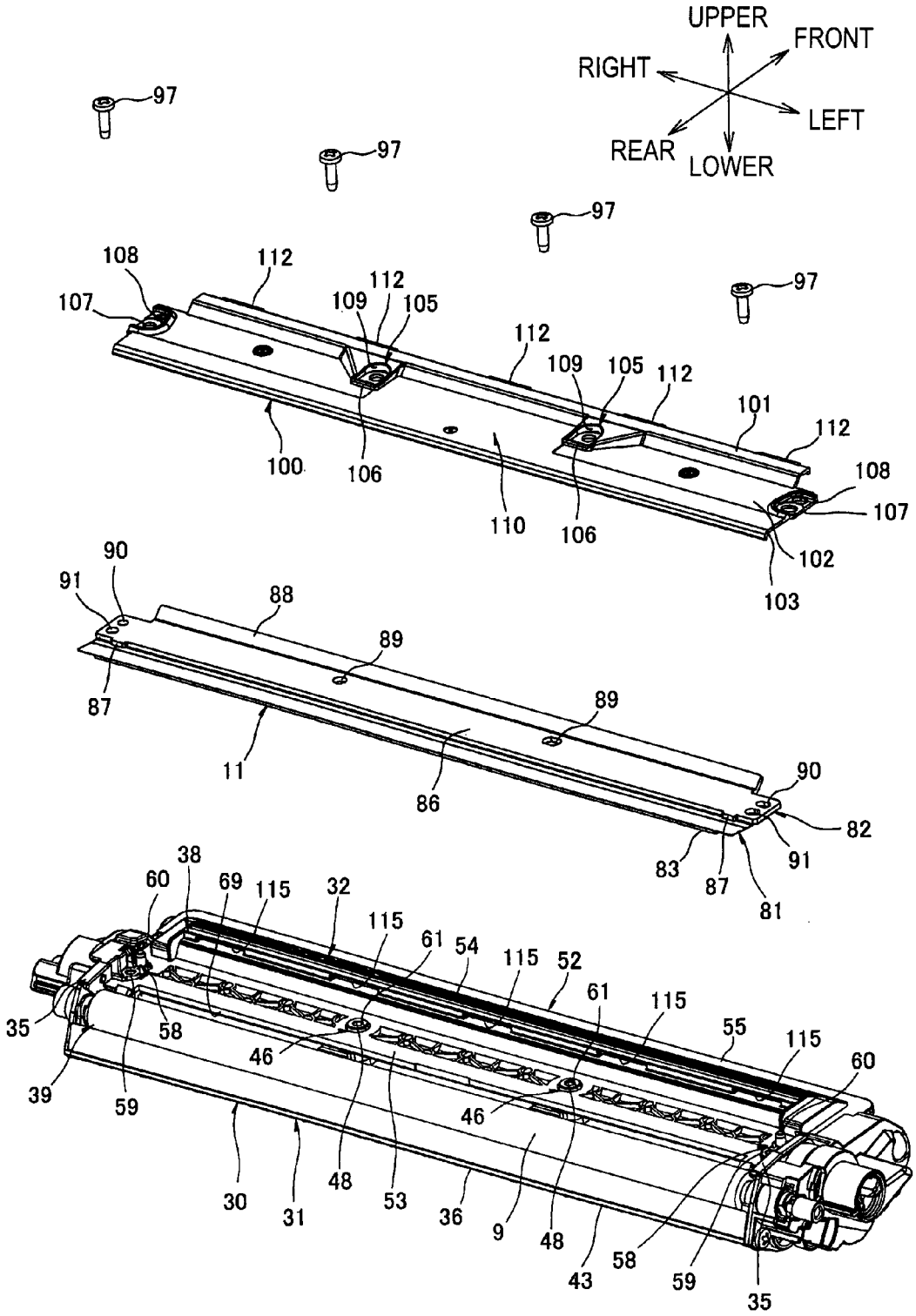
FIG. 6 is an exploded perspective view of the developing cartridge shown in FIG. 2, as viewed from the left-upper side.

As shown in FIGS. 3 and 6, the upper frame 32 has a substantially flat plate shape extending in the left-right direction and integrally has a front-side upper wall 52 and the rear-side upper wall 53.

The front-side upper wall 52 has a bulging part 54 and an abutting part 55.

The bulging part 54 is formed to bulge upwards on the substantially entire front-side upper wall 52.

An upper end portion of the bulging part 54 is formed with a plurality (five) of engaging recess portions 115. The engaging recess portions 115 are arranged in parallel at an interval in the left-right direction so that they correspond to engaging protruding portions 112 (which will be described later) of a covering member 100 (which will be described later). The engaging recess portion 115 has a substantially U-shaped section that is opened rearwards and also has a substantially rectangular shape extending in the left-right direction as viewed from the backside The abutting part 55 has a substantially flat plate shape and is provided at left and right sides and a front side of the bulging part 54 so that it surrounds the bulging part 54. Also, the abutting part 55 is formed to correspond to the first abutted part 56 and the second abutted part 57 when the upper frame 32 is assembled to the lower frame 31.

The rear-side upper wall 53 has a substantially flat plate shape extending rearwards continuously from the rear end portion of the front-side upper wall 52. The rear-side upper wall 53 is arranged between the upper end portions of both sidewalls 35 so that it faces the arc-shaped wall 42 of the lower frame 31 at an interval in the upper-lower direction.

Also, left and right end portions of the rear-side upper wall 53 are notched into a substantially rectangular shape as viewed from a plan view so that the first fixing parts 58 are exposed when the upper frame 32 is assembled to the lower frame 31.

Also, the rear-side upper wall 53 is formed with a plurality (two) of through-holes 61.

The through-holes 61 are arranged in parallel at an interval in the left-right direction at the central part of the rear-side upper wall 53 in the left-right direction. The through-hole 61 has a substantially circular shape having a diameter larger than an outer diameter of the second fixing part 46 as viewed from the plan view so that the upper end portion of the second fixing part 46 is inserted therein when the upper frame 32 is assembled to the lower frame 31.

Also, as shown in FIGS. 3 and 4, a lower surface of the rear-side upper wall 53 is formed with cylindrical parts 62.

The cylindrical part 62 has a substantially cylindrical shape extending downwards from a peripheral part of the through-hole 61 and is arranged so that an axial line thereof coincides with a center of the through-hole 61. Thereby, an internal space of the cylindrical part 62 communicates with the through-hole 61. An inner diameter of the cylindrical part 62 is larger than the diameter of the through-hole 61.

An elastic member 67 is provided between a lower surface (an outer edge of the through-hole 61) of the rear-side upper wall 53 in the cylindrical part 62 and an upper end portion of the projection 47 (refer to FIG. 4).

The elastic member 67 has a substantial ring shape, an inner diameter that is substantially the same as an outer diameter of the second fixing part 46 and an outer diameter that is substantially the same as an inner diameter of the cylindrical part 62. The elastic member 67 seals between an inner peripheral surface of the cylindrical part 62 and an outer peripheral surface of an upper end portion (a part above the projection 47) of the second fixing part 46.

(1-3) Toner Accommodation Chamber and Developing Chamber

As shown in FIG. 3, the developing frame 30 is partitioned so that a front space of the partition wall 45 is defined as a toner accommodation chamber 38 and a rear space of the partition wall 45 is defined as a developing chamber 39.

Also, a rear end portion of the developing frame 30 is formed with an opening 69 that is opened rearwards. Specifically, the opening 69 is defined by the rear end portions of both sidewalls 35, the rear end portion of the lip part 43 and the rear end portion of the rear-side upper wall 53.

Specifically, the toner accommodation chamber 38 is defined by both sidewalls 35, the partition wall 41, the bent wall 40, the front wall 37, the front-side upper wall and a front part of the rear-side upper wall 53.

The toner accommodation chamber 38 is filled with the toner and is provided with an agitator 72 for stirring the toner.

Specifically, the developing chamber 39 is defined by both sidewalls 35, the partition wall 45, the arc-shaped wall 42, the lip part 43 and the rear part of the rear-side upper wall 53.

Also, as described above, the supply roller 10 and the developing roller 9 are rotatably supported to the developing chamber 39.

The supply roller 10 is arranged in the developing chamber 39 so that a circumferential surface thereof follows an inner peripheral surface of the arc-shaped wall 42. The supply roller 10 is rotated in an arrow direction of FIG. 3 (in a counterclockwise direction, as viewed from the left side).

The developing roller 9 is arranged at the rear-upper side of the supply roller 10 so that it is exposed rearwards from the opening 69 and is contacted to the supply roller 10 from the rear-upper side of the supply roller. The developing roller 9 is rotated in the arrow direction of FIG. 3 (in a counterclockwise direction, as viewed from the left side).

(2) Layer Thickness Regulation Blade

Also, as shown in FIGS. 3 and 6, the developing cartridge 7 has the layer thickness regulation blade 11.

The layer thickness regulation blade 11 has a blade member 81 that is an example of the first plate-shaped member and a reinforcement member 82 that is an example of the second plate-shaped member.

The blade member 81 is formed of a thin metal plate having elasticity and has a substantially flat plate shape that is long in the left-right direction.

A front end portion (the other end portion) of the blade member 81 is arranged on the rear-side upper wall 53 and a rear end portion (one end portion) of the blade member 81 is arranged to face the outer peripheral surface of the developing roller 9 at a slight interval. The rear end portion of the blade member 81 is provided with a contact part 83.

The contact part 83 is made of an elastic resin such as silicon resin and is provided on a lower surface of the blade member 81 along the left-right direction, protrudes downwards, and it has a substantial arc shape, as viewed from the side. The contact part 83 contacts the developing roller 9 from the upper side thereof. That is, the blade member 81 is arranged so that the rotating direction of the developing roller 9 (the rotating direction indicated with the arrow in FIG. 3, i.e., the counterclockwise direction as viewed from the left side) is the same as a direction from the front end portion of the blade member 81 toward the rear end portion thereof at a contacting portion of the contact part 83.

The reinforcement member 82 is formed of a thick metal plate having rigidity higher than that of the blade member 81 and integrally has a main body part 86, protrusion parts 87 that protrude from a rear end portion of the main body part 86 and an extension part 88 that extends from a front end portion of the main body part 86 toward the front-upper side. The reinforcement member 82 is arranged at an upper side of the blade member 81, i.e., is arranged at an opposite side to the bottom wall 36 with respect to the blade member 81.

The main body part 86 has a substantially flat plate shape extending in the left-right direction. Also, the main body part 86 has a length in the front-rear direction shorter than the blade member 81. The main body part 86 is formed with a plurality (two) of positioning holes 90, a plurality (two) of first fixing holes 91 and a plurality (two) of second fixing holes 89.

The positioning holes 90 are respectively arranged at left and right ends of the main body part 86 with corresponding to the positioning protrusions 60 of the lower frame 31. The right positioning hole 90 is a circular hole, and the left positioning hole 90 is a long hole.

The first fixing holes 91 are respectively arranged at left and right ends of the main body part 86 so that they correspond to the first screw holes 59 of the lower frame 31. The right first fixing hole 91 is a circular hole, and the left first fixing hole 91 is a long hole. The first fixing holes 91 are arranged in series at the rear of the positioning holes 90.

The second fixing holes 89 are arranged in parallel at an interval in the left-right direction at a central part of the main body part 86 in the left-right direction so that they correspond to the through-holes 61 of the lower frame 31. One of the second fixing holes 89 is a circular hole, and the other of the second fixing holes 89 is a long hole.

All the second fixing holes 89 are arranged on the same line together with all the positioning holes 90.

The protrusion parts 87 have a substantially rectangular shape, respectively, as viewed from the left-right side, and are respectively provided to both left and right ends of the reinforcement member 82.

The extension part 88 has a substantially flat plate shape that is long in the left-right direction. The extension part 88 is bent toward the front-upper side continuously from the front end of the main body part 86.

An upper surface of a front part of the blade member 81 and a lower surface of a rear part of the main body part 86 are attached to each other, so that the blade member 81 and the reinforcement member 82 are fixed. Thereby, the rear part of the blade member 81 is exposed through the reinforcement member 82.

In the meantime, the front part of the blade member 81 is formed with through-holes (not shown) at positions facing the first fixing holes 91.

Also, a seal member 94 is provided between the layer thickness regulation blade 11 and the rear-side upper wall 53 of the developing frame 30 (refer to FIG. 4).

The seal member 94 is formed of an elastic member such as sponge seal and has a rectangular flat plate shape, as viewed from a section extending in the front-rear direction, and it is arranged between an upper surface of the rear-side upper wall 53 and a lower surface of the front part of the blade member 81. That is, the rear part of the main body part 86 and the rear-side upper wall 53 are arranged to sandwich the front part of the blade member 81 and the seal member 94. Thereby, the seal member 94 closes a gap between the layer thickness regulation blade 11 and the rear-side upper wall 53.

(3) Covering Member

Also, the developing cartridge 7 has a covering member 100 for covering the layer thickness regulation blade 11.

The covering member 100 is arranged at the upper side of the layer thickness regulation blade 11, i.e., is arranged at an opposite side to the bottom wall 36 with respect to the layer thickness regulation blade 11. The covering member 100 is made of a resin and has a substantially flat plate shape extending in the left-right direction.

As shown in FIG. 6, the covering member 100 has a covering main body part 102, an engaging part 101 and a covering rear end portion 103.

The covering main body part 102 has a substantially flat plate shape that is long in the left-right direction.

The covering main body part 102 is formed with a plurality (two) of fixed parts 105 at parts corresponding to the through-holes 61 of the upper frame 32 and the second fixing holes 89 of the layer thickness regulation blade 11.

The fixed parts 105 are arranged in parallel at an interval in the left-right direction at a central part of the covering main body part 102 in the left-right direction, and are formed to protrude upwards at a rear end portion of the covering main body part 102. The fixed part 105 is formed with an accommodation part 109 that accommodates a screw member 97 therein.

The accommodation part 109 is a recess part that is recessed downwards from an upper surface of the fixed part 105 and has a substantial square shape. A bottom wall of the accommodation part 109 is formed with a fixed-part hole 106.

The fixed-part hole 106 penetrates the bottom wall of the accommodation part 109 and has a substantially circular shape, as viewed from a plan view. A diameter of the fixed-part hole 106 is substantially the same as that of the second fixing hole 89.

Also, the covering main body part 102 is formed with covering-member positioning holes 108 and covering-member first fixing holes 107.

The covering-member positioning holes 108 are formed at left and right end portions of the covering main body part 102 at positions corresponding to the positioning protrusions 60.

The covering-member first fixing holes 107 are formed at left and right end portions of the covering main body part 102 at positions corresponding to the first screw holes 59.

The engaging part 101 has a substantially flat plate shape that continues to a front end portion of the covering main body part 102 and is long in the left-right direction. Specifically, the engaging part 101 is inclined upwards from the covering main body part 102 toward the front, is horizontally bent rearwards at an upper end portion thereof and is bent downwards at a front end portion thereof. Also, the engaging part 102 has a plurality (five) of engaging protruding portions 112.

The engaging protruding portions 112 are arranged in parallel at an equal interval in the left-right direction. The engaging protruding portion 112 has a substantially rectangular flat plate shape as viewed from a plan view extending in the left-right direction so that it slightly protrudes from a front side of an upper end portion of the engaging part 101.

The covering rear end portion 103 has a substantially flat plate shape that extends rearwards continuously from a rear end portion of the covering main body part 102 and is long in the left-right direction. A length of the covering rear end portion 103 in the left-right direction is substantially the same as that of the blade member 81 in the left-right direction.

A rear end portion of the covering rear end portion 103 is bent downwards toward the rear. A rear end edge of the covering rear end portion 103 is formed so that it is arranged at the rear side of a rear end edge of the blade member 81 and the lower side thereof.

A grip 110 is defined as a part between the two fixed parts 105 at the engaging part 101 and a part of the covering main body part 102. That is, the grip 110 is configured by the covering main body part 102 (flat part) between the fixed parts 105 and the engaging part 101 continuing forwards from the flat part, and it has a step shape to be spaced from the layer thickness regulation blade 11.

Also, the grip 110 is formed so that it does not overlap with the fixed parts 105 and the second fixing parts 46, as projected in the upper-lower direction. Also, the grip 110 is arranged at the upper side of the reinforcement member 82 so that it overlaps with the reinforcement member 82 at the covering main body part 102 (flat part) between the fixed parts 105, as projected in the upper-lower direction.

(4) Assembling of Developing Cartridge

As shown in FIG. 6, in order to assemble the developing cartridge 6, the agitator 72, the supply roller 10 and the developing roller 9 are first mounted to the lower frame 31.

Then, the upper frame 32 is mounted to the lower frame 31.

In order to mount the upper frame 32 to the lower frame 31, the elastic members 67 are fitted on the outer sides of the upper end portions of the second fixing parts 46 (refer to FIG. 4).

Then, the upper frame 32 is overlapped with the lower frame 31 from the upper so that the upper end portions of the second fixing parts 46 of the lower frame 31 are inserted into the through-holes 61 of the upper frame 32. Thereby, the abutting part 55 of the upper frame 32 coincides with the first abutted parts 56 and the second abutted part 57 of the lower frame 31.

At this time, the upper end portions of the second fixing parts 46 protrude upwards from the rear-side upper wall 53.

Then, the abutting part 55 of the upper frame 32 and the first abutted parts 56 and the second abutted part 57 of the lower frame 31 are melted.

Thereby, the developing frame 30 is formed.

Next, the layer thickness regulation blade 11 and the covering member 100 are mounted to the upper frame 32.

In order to arrange the layer thickness regulation blade 11 on the upper frame 32, the layer thickness regulation blade 11 and the seal member 94 are first prepared.

Next, the seal member 94 is bonded on the upper surface of the rear-side upper wall 53 of the upper frame 32 (refer to FIG. 3).

Then, the layer thickness regulation blade 11 is overlapped with the rear-side upper wall 53 from the upper so that the positioning protrusions 60 of the first fixing parts 58 are inserted into the positioning holes 90 of the reinforcement member 82. Thereby, the first screw holes 59 of the first fixing parts 58 are exposed through the first fixing holes 91, and the second screw holes 48 of the second fixing parts 46 are exposed through the second fixing holes 89 via the through-holes 61.

Then, the covering member 100 is arranged at the upper side of the layer thickness regulation blade 11.

In order to arrange the covering member 100 on the layer thickness regulation blade 11, the covering member 100 as described above is prepared at first.

Then, all (five) the engaging protruding portions 112 of the covering member 100 are fitted into all (five) the engaging recess portions 115 of the upper frame 32, so that the covering member 100 is arranged at the upper side of the reinforcement member 82 of the layer thickness regulation blade 11.

Thereby, the positioning protrusions 60 of the first fixing parts 58 are inserted into the covering-member positioning holes 108 of the covering member 100. Also, the first screw holes 59 of the first fixing parts 58 are exposed through the covering-member first fixing holes 107. The second screw holes 48 of the second fixing parts 46 are exposed through the corresponding fixed-part holes 106 via the respective through-holes 61. In the meantime, at this time, the covering member 100 is arranged to face the blade member 81 at an interval and is arranged to face the reinforcement member 81 with contacting.

Then, in order to mount the layer thickness regulation blade 11 and the covering member 100 to the lower frame 31, the screw members 97 are screwed into the second screw holes 48 through the second fixing holes 89 and the fixed-part holes 106 and are also screwed into the first screw holes 59 through the first fixing holes 91 and the covering-member first fixing holes 107.

Thereby, the layer thickness regulation blade 11 and the covering member 100 are fixed to the lower frame 31.

Accordingly, the assembling of the developing cartridge 7 is completed.

3. Gripping of Developing Cartridge

As an example of an aspect of handing the developing cartridge 7, an aspect of gripping the developing cartridge 7 with one hand will be described.

In order to grip the developing cartridge 7, first joints of second, third and fourth fingers are to be bend to put the fingers on the step shape of the grip 110 of the developing cartridge 7. Also, a first finger is pressed on the bottom wall 36 of the developing cartridge 7. Thereby, the developing cartridge 7 is gripped as it is sandwiched in the upper-lower direction.

4. Effects (1) According to the developing cartridge 7, as shown in FIG. 3, the layer thickness regulation blade 11 is covered by the covering member 100 that is arranged at the opposite side (upper side) to the bottom wall 36 and the covering member 100 has the grip 110.

Therefore, it is possible to grip the developing frame 30 by using the grip 110 of the covering member 100. Thereby, it is possible to handle the developing cartridge 7 without contacting the layer thickness regulation blade 11.

As a result, it is possible to protect the layer thickness regulation blade 11 and also the developing roller 9 contacting the layer thickness regulation blade 11 and to smoothly handle the developing cartridge 7.

(2) Further, according to the developing cartridge 7, as shown in FIG. 3, the reinforcement member 82 is arranged to overlap with the grip 110 as projected in the direction from the layer thickness regulation blade 11 toward the covering member 100.

Accordingly, when gripping the developing frame 30, it is possible to contact the covering member 100 at the part overlapping with the reinforcement member 82 fixing the blade member 81.

Therefore, even if the covering member 100 is pressed toward the layer thickness regulation blade 11 when gripping the developing frame 30, it is possible to bear the pressing force by the reinforcement member 82.

As a result, it is possible to suppress the excessive pressure from being applied to the developing roller 9 contacting the blade member 81.

(3) Further, according to the developing cartridge 7, as shown in FIG. 3, the covering member 100 is arranged to face the blade member 81 at an interval.

Therefore, even if the load facing the blade member 81 is applied to the covering member 100 when gripping the grip 110 of the covering member 100, it is possible to suppress the covering member 100 from pressing the blade member 81.

As a result, it is possible to suppress the blade member 81 from excessively pressing the developing roller 9.

(4) Further, according to the developing cartridge 7, as shown in FIG. 3, the blade member 81 is arranged so that the rotating direction of the developing roller 9 is the same as the direction from the other end portion of the blade member 81 toward the one end portion thereof at the contacting portion of the developing roller 9 and the contact part 83 of the layer thickness regulation blade 11.

Therefore, it is possible to make the developing cartridge 7 smaller.

(5) Further, according to the developing cartridge 7, as shown in FIG. 3, the rear end portion of the covering member 100 is arranged at the more downstream side (rear side) of the rear end portion of the blade member 81 in the direction from the front end portion of the blade member 81 toward the rear end portion, and the rear end portion of the covering member 100 is arranged closer to the bottom wall 36-side (lower side) than the rear end portion of the blade member 81.

Therefore, the rear end portion of the blade member 81 is covered by the covering member 100.

Therefore, it is possible to reduce the scattering of the toner between the rear end portion (contact part 83) of the blade member 81 and the developing roller 9 and to protect the one end portion of the blade member 81.

(6) Further, according to the developing cartridge 7, as shown in FIGS. 3 and 6, the covering member 100 has the engaging part 101 that is engaged with the upper frame 32 at the front end portion.

Therefore, it is possible to integrally engage the covering member 100 with the upper frame 32 at the engaging part 101. Thereby, it is possible to stably grip the developing frame 30 of the developing cartridge 7.

(7) Further, according to the developing cartridge 7, as shown in FIG. 2, the grip 110 is provided at the central part of the covering member 100 in the left-right direction.

Accordingly, it is possible to grip the developing cartridge 7 in a balanced manner in the left-right direction.

(8) Further, according to the developing cartridge 7, as shown in FIG. 4, the developing roller 9 is supported to the lower frame 31 having the bottom wall 36. Also, the bottom wall 36 has the plurality (two) of second fixing parts 46, which is are vertically arranged to penetrate the rear-side upper wall 53 and is to be fixed the layer thickness regulation blade 1.

Therefore, it is possible to fix the covering member 100 and the layer thickness regulation blade 11 to the second fixing parts 46 that are vertically arranged to penetrate the rear-side upper wall 53 from the bottom wall 36.

Accordingly, even if the covering member 100 and the layer thickness regulation blade 11 are pressed in the direction from the rear-side upper wall 53 toward the bottom wall 36 when gripping the developing frame 30, it is possible to bear the pressing force by the second fixing parts 46.

As a result, it is possible to improve the strength of the developing frame 30 in the direction from the rear-side upper wall 53 toward the bottom wall 36.

Also, it is possible to fix all of the developing roller 9, the layer thickness regulation blade 11 and the covering member 100 to the lower frame 31.

As a result, it is possible to position a relative arrangement of the developing roller 9, the layer thickness regulation blade 11 and the covering member 100 with good precision.

(9) Further, according to the developing cartridge 7, as shown in FIGS. 2 and 6, the second fixing parts 46 are arranged so that they do not overlap with the grip 110, as projected in the direction from the layer thickness regulation blade 11 toward the covering member 100.

Therefore, it is possible to grip the developing frame 30 without contacting the second fixing parts 46. Accordingly, it is possible to protect the second fixing parts 46 and to stably grip the developing frame 30.

(10) Further, according to the developing cartridge 7, as shown in FIG. 3, the grip 110 has the step shape that is spaced from the layer thickness regulation blade 11 in the direction from the rear-side upper wall 53 toward the bottom wall 36.

Therefore, it is possible to grip the developing cartridge 7 more stably by using the step shape.

5. Modified Embodiments

Modified embodiments of the developing cartridge 7 are described with reference to FIGS. 7 to 10. In FIGS. 7 to 10, the same members as those of the first illustrative embodiment are denoted with the same reference numerals, and the descriptions thereof will be omitted.

Figure 7:
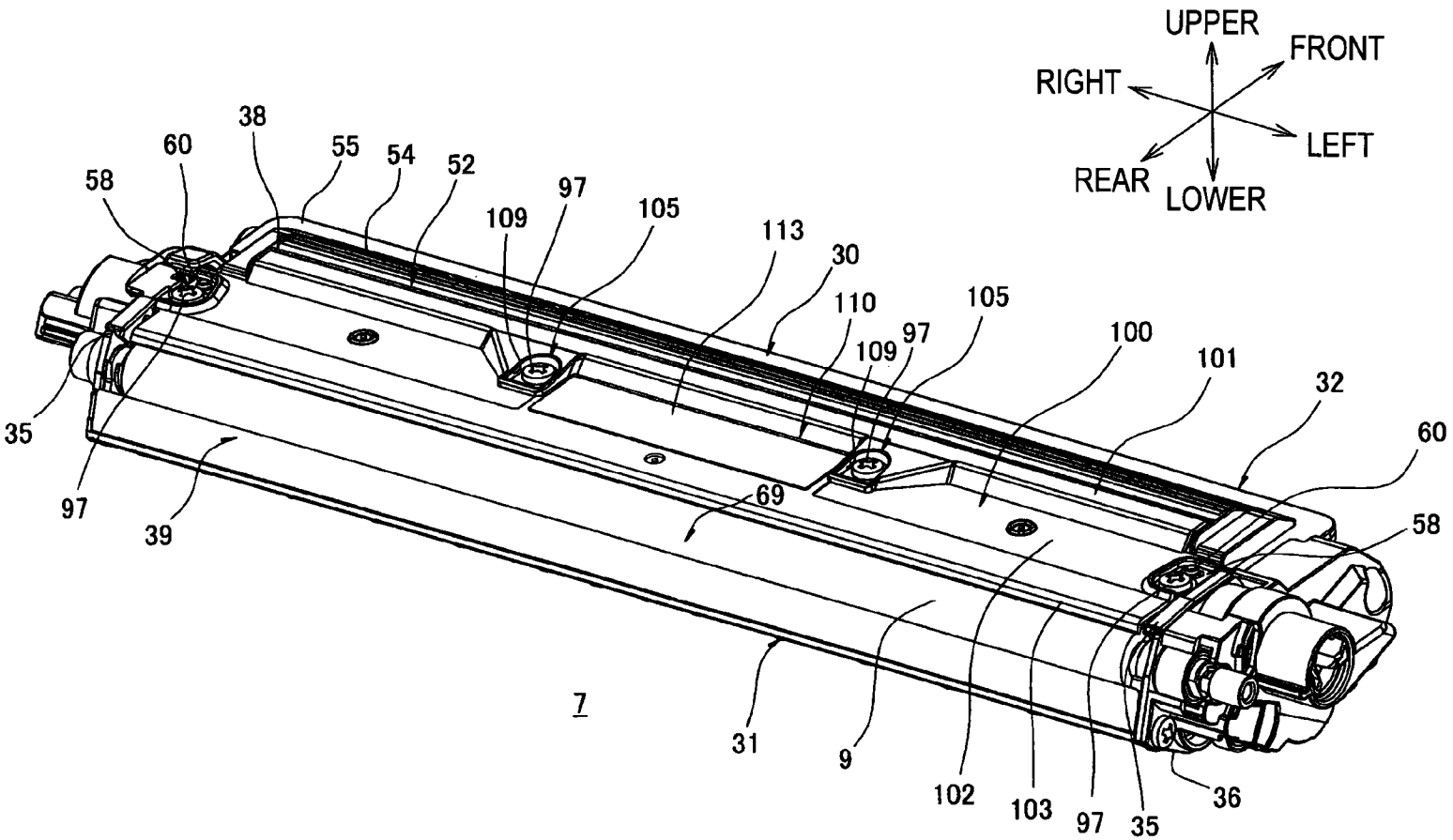
FIG. 7 is a perspective view of a developing cartridge according to another illustrative embodiment, as viewed from the left-upper side.

(1) As shown in FIG. 7, a slip-proof seal 113 may be attached on the flat part of the grip 110 of the covering member 100.

Figure 8:
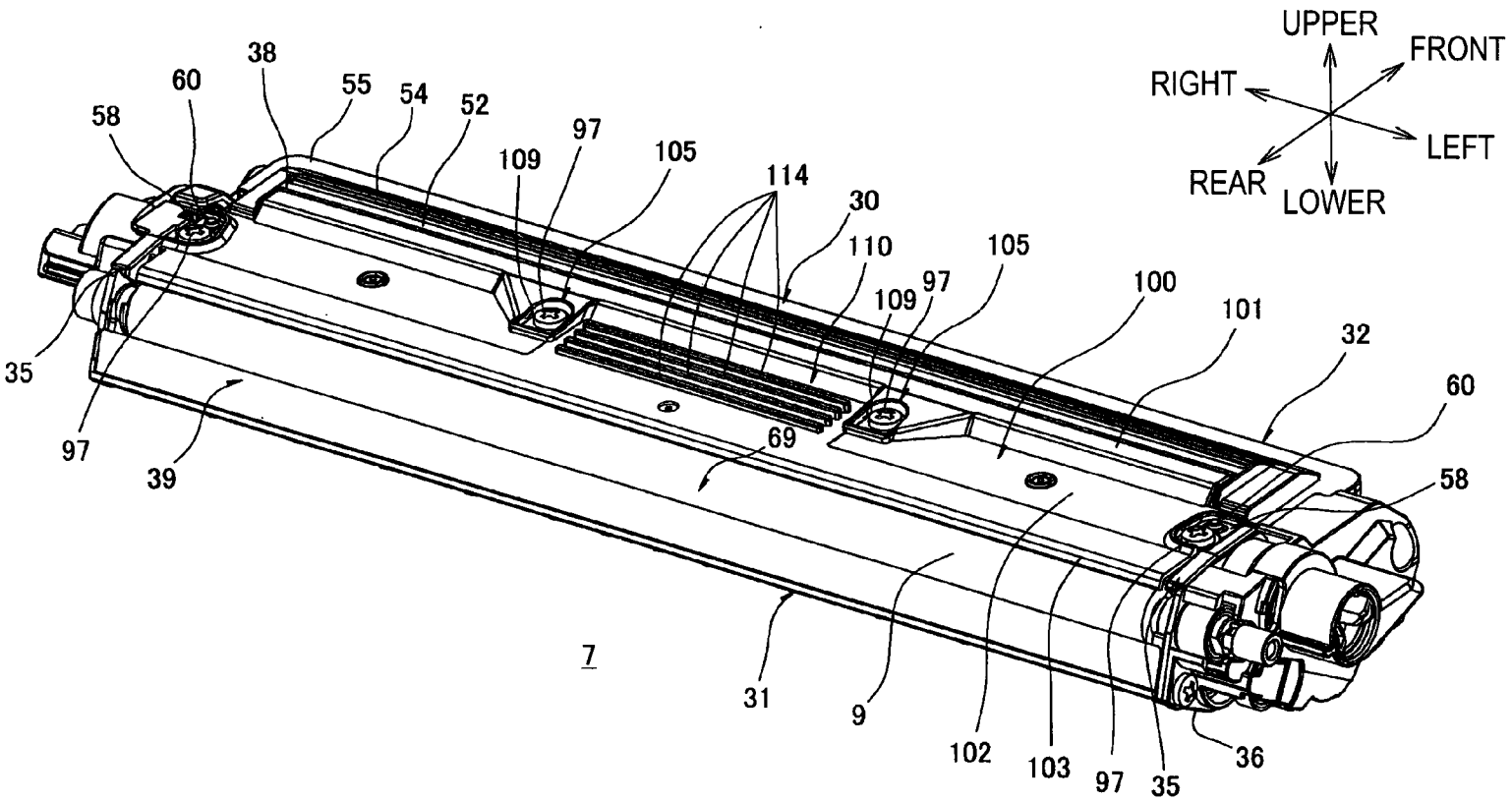
FIG. 8 is a perspective view of a developing cartridge according to another illustrative embodiment, as viewed from the left-upper side.

Also, as shown in FIG. 8, a plurality (four) of anti-slip protrusions 114 may be formed on the flat part of the grip 110. The anti-slip protrusions 114 are configured by protrusions that extend in the left-right direction and are arranged in parallel in the front-rear direction. The anti-slip protrusions 114 are configured so that heights thereof in the upper-lower direction are gradually increased as proceeding forwards.

Figure 9:
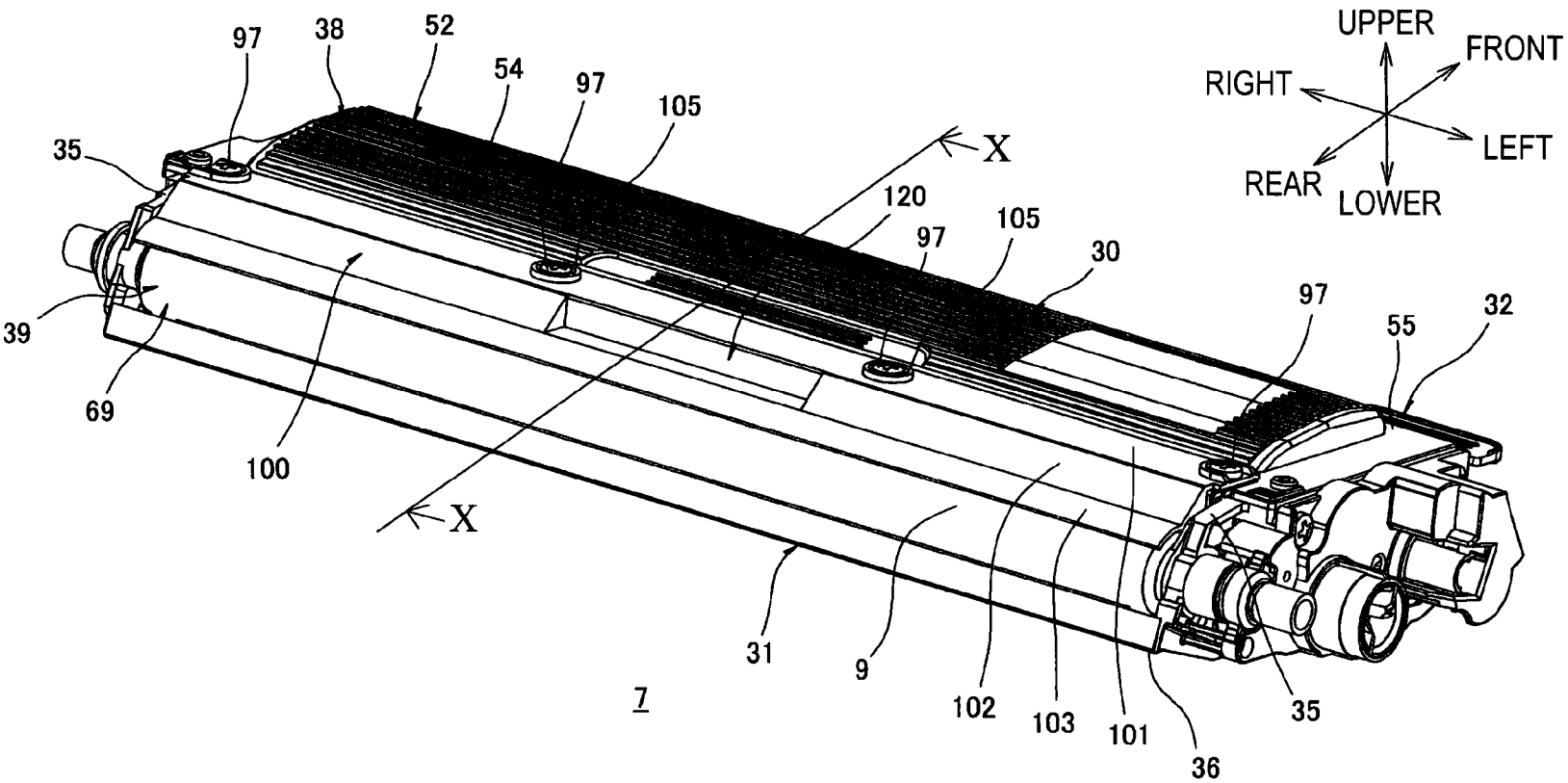
FIG. 9 is a perspective view of a developing cartridge according to another illustrative embodiment, as viewed from the left-upper side.
Figure 10:
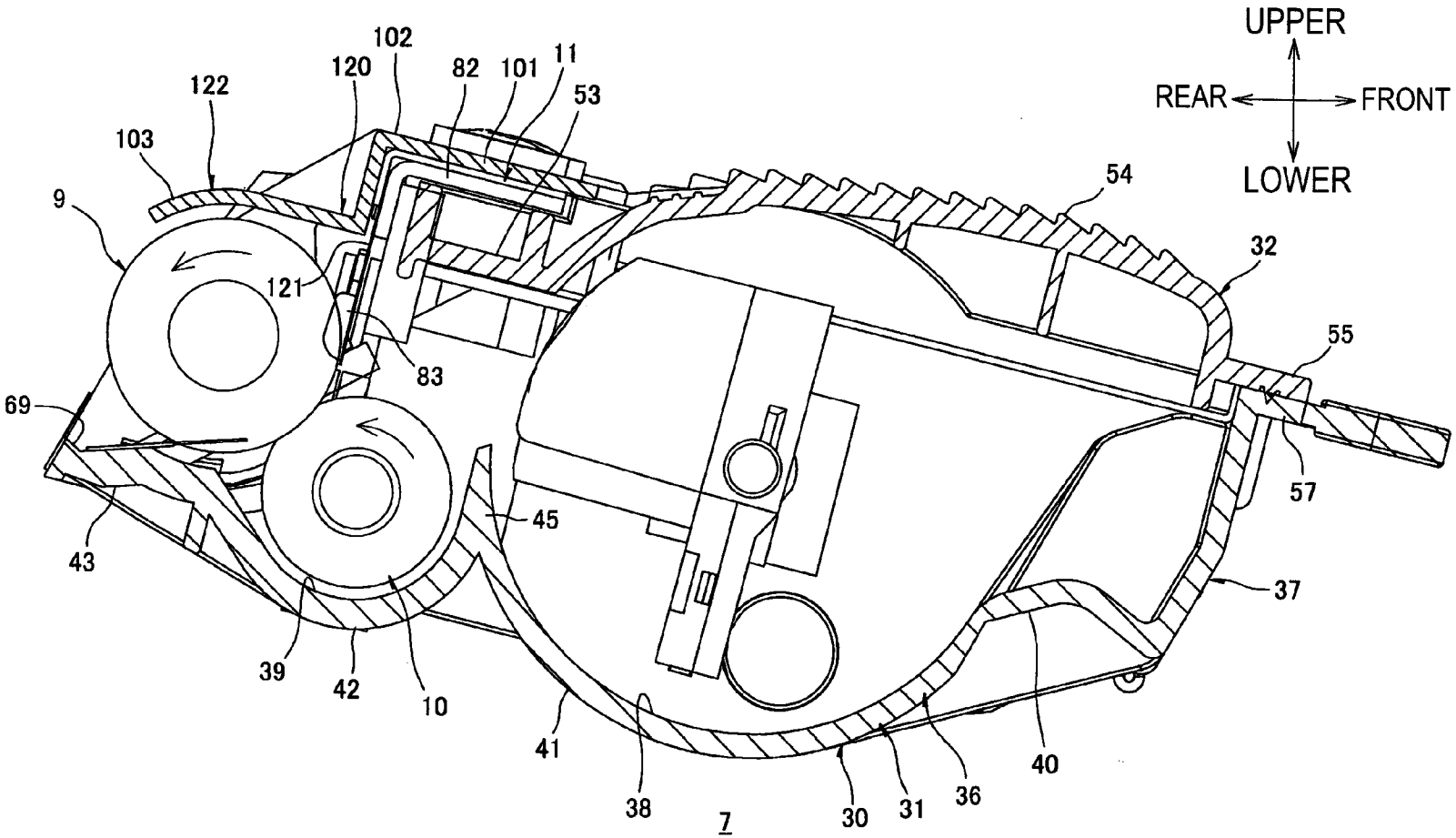
FIG. 10 is a sectional view taken along a line X-X of the developing cartridge shown in FIG. 9.

(2) Further, as shown in FIG. 3, according to the covering member 100, the blade member 81 is arranged so that the rotating direction of the developing roller 9 is the same as the direction from the other end portion (the end portion to be fixed to the developing frame 30) of the blade member 81 toward the one end portion thereof (the end portion contacting the developing roller 9) at the contacting portion of the contact part 83. However, as shown in FIGS. 9 and 10, a blade member 121 may be arranged so that the rotating direction of the developing roller 9 is opposite to the direction from the other end portion (the end portion to be fixed to the developing frame 30) of the blade member 121 toward the one end portion thereof (the end portion contacting the developing roller 9) at the contacting portion of the contact part 83.

Specifically, the blade member 121 is arranged at the front side of the developing roller 9. At this time, a covering member 122 is formed to follow the upper end of the developing roller 9 at an interval from the developing roller 9. That is, the covering member 122 is bent downwards to have a gently curved surface as preceding the rear side. Also, the covering member 122 is formed with a stair part 120, which is an example of the grip, at a center thereof in the left-right direction. The stair part 120 has a substantially L-shaped section.

(3) Further, the covering member 100 is made of the rigid resin. However, a part of the covering member 100, specifically the covering rear end portion 103 may be formed with a film.

What is claimed is:

1. A cartridge comprising:

a housing that has a first wall part and a second wall part arranged at an interval from the first wall part and is configured to accommodate developer;

a developer carrier that is rotatably supported to the housing and carries the developer;

a layer thickness regulation member that is supported to the housing so that it is arranged at an opposite side to the second wall part with respect to the first wall part and that is configured to regulate a layer thickness of the developer carried on a surface of the developer carrier, the layer thickness regulation member comprising:

a first plate-shaped member that contacts the developer carrier, and a second plate-shaped member that is arranged at an opposite side to the second wall part with respect to the first plate-shaped member and fixes the first plate-shaped member; and a covering member that is arranged at an opposite side to the second wall part with respect to the layer thickness regulation member and covers the layer thickness regulation member, wherein the covering member has a grip to grip the housing, and wherein the second plate-shaped member is arranged to overlap with at least a portion of the grip, as projected in a direction from the layer thickness regulation member toward the covering member, wherein the first plate-shaped member has a contact part that contacts the developer carrier at one end portion thereof and is supported to the housing at another end portion thereof, wherein the first plate-shaped member is arranged so that a rotating direction of the developer carrier is the same as a direction from the other end portion of the first plate-shaped member toward the one end portion thereof at a contacting portion of the developer carrier and the contact part, wherein the one end portion of the covering member is arranged at a downstream side of the one end portion of the first plate-shaped member in the direction from the other end portion of the first plate-shaped member toward the one end portion, and wherein the one end portion of the covering member is arranged at a side closer to the second wall part-side than the one end portion of the first plate-shaped member.

2. The cartridge according to claim 1, wherein the covering member is arranged to face the first plate-shaped member at an interval.

3. The cartridge according to claim 1, wherein the covering member has an engaging part to engage with the first wall part at another end portion thereof.

4. The cartridge according to claim 1, wherein the grip is provided at a central part of the covering member in a rotary shaft direction of the developer carrier.

5. The cartridge according to claim 1, wherein the second wall part has at least one fixing part, to which the layer thickness regulation member is fixed, and which is vertically arranged to penetrate the first wall part, and wherein the covering member has a fixed part that is fixed to the fixing part.

6. The cartridge according to claim 5, wherein the fixing part is arranged so that it does not overlap with the grip, as projected in a direction from the layer thickness regulation member and the covering member.

7. The cartridge according to claim 1, wherein the grip has a step shape to be spaced from the layer thickness regulation member in a direction from the first wall part and the second wall part.

* * * * *